US006046665A

United States Patent [19]

Oh et al.

[11] Patent Number: 6,046,665

[45] Date of Patent: Apr. 4, 2000

[54] FUSIBLE LINK, AND LINK AND CABLE ASSEMBLY

[75] Inventors: Seibang Oh, Elk Grove Village; Demetrios Thanopoulos, Arlington Heights, both of Ill.

[73] Assignee: Littelfuse, Inc., Des Plaines, Ill.

[21] Appl. No.: 09/234,012

[22] Filed: Jan. 19, 1999

Related U.S. Application Data

[63] Continuation-in-part of application No. 08/803,717, Feb. 21, 1997, which is a continuation-in-part of application No. 08/697,337, Aug. 22, 1996.

[51] Int. Cl.[7] ..... H01H 85/02; H01H 71/08; H01R 13/68

[52] U.S. Cl. ..... 337/191; 337/181; 337/186; 439/621; 439/893

[58] Field of Search ..... 337/181, 158, 337/159, 188, 234, 186, 191, 227; 439/621, 622, 893; 29/623

[56] References Cited

U.S. PATENT DOCUMENTS

| | | | |
|---|---|---|---|
| 1,175,103 | 3/1916 | Williams | 337/192 |
| 1,579,596 | 4/1926 | Cote . | |
| 2,414,865 | 1/1947 | Genter | 337/191 |
| 2,872,501 | 2/1959 | McMahon . | |
| 3,422,213 | 1/1969 | Webb . | |
| 3,601,737 | 8/1971 | Baird et al. . | |
| 3,766,307 | 10/1973 | Andrews, Jr. . | |
| 3,766,509 | 10/1973 | Cameron . | |
| 4,280,748 | 7/1981 | McHenney et al. . | |
| 4,308,515 | 12/1981 | Rooney et al. . | |
| 4,333,701 | 6/1982 | Schick | 339/97 P |
| 4,365,226 | 12/1982 | Barry et al. . | |
| 4,391,485 | 7/1983 | Urani | 339/191 |
| 4,679,877 | 7/1987 | Ahroni | 439/425 |
| 4,734,059 | 3/1988 | Melvgin | 439/621 |
| 4,831,353 | 5/1989 | Gaia et al. . | |
| 4,880,943 | 11/1989 | Kuzuno et al. . | |
| 4,958,426 | 9/1990 | Endo et al. | 29/623 |
| 5,018,991 | 5/1991 | Katz et al. | 439/621 |
| 5,162,773 | 11/1992 | Shiozaki . | |
| 5,241,134 | 8/1993 | Yoo . | |
| 5,298,877 | 3/1994 | Gurevich et al. . | |
| 5,304,740 | 4/1994 | Bozell et al. . | |
| 5,329,065 | 7/1994 | Marney et al. . | |
| 5,345,210 | 9/1994 | Swensen et al. . | |
| 5,391,836 | 2/1995 | Bortas et al. . | |
| 5,493,069 | 2/1996 | Conti . | |
| 5,591,366 | 1/1997 | Schmidt et al. . | |

*Primary Examiner*—Leo P. Picard
*Assistant Examiner*—Anatoly Vortman
*Attorney, Agent, or Firm*—Wallenstein & Wagner, Ltd.

[57] ABSTRACT

An improved cable assembly for electrical overload protection, the cable assembly having a first cable, a second cable, a fusible link, and a protective housing. The first and second cables have a protective covering and an end portion extending past the protective covering. The fusible link is located between the first and second cables such that the end portions of the cables are electrically connected to opposing ends of the fusible link. The protective housing encases a portion of the fusible link, with an intermediate section of the protective housing being spaced away from a portion of the fusible link to form a cavity. The protective housing also engages a portion of the first and second cables to form a rigid interconnecting housing around the fusible link and portions of the first and second cables.

28 Claims, 6 Drawing Sheets

FUSIBLE LINK, AND LINK AND CABLE ASSEMBLY

RELATED APPLICATIONS

This application is a continuation-in-part of U.S. patent application Ser. No. 08/803,717 which is a continuation-in-part of U.S. patent application Ser. No. 08/697,337. U.S. patent application Ser. Nos. 08/697,337 and 08/803,717 are hereby incorporated herein by reference, and made a part hereof.

TECHNICAL FIELD

The invention relates to the field of electrical protection, and is particularly directed to an improved fusible link for protecting electrical devices, and also to an improved cable assembly for protectively coupling two cables and a fusible link.

BACKGROUND OF THE INVENTION

Automobiles are increasingly reliant on electronic controls and engine management systems. As a result of these controls and systems, modem automobiles are much more dependable than prior autos, which instead used more vulnerable mechanical systems. Although the hardware embodying the electronic controls and systems is rather dependable, the failure of the means for directly or indirectly bringing electrical current to such hardware continues to be a rare but, nevertheless, significant source of automotive breakdowns. An automotive breakdown, especially in a deserted area or on a very busy high-speed road, is obviously a safety hazard to the automobile and its passengers.

One specific type of failure in prior art means can lead to an even more hazardous condition than automotive breakdown. This failure occurs at the junction wherein a fusible link is connected to an electrical center through a stud mounting. Typically a nut and threaded stud combination fixes the fusible link to the electrical center. However, due to incorrect torquing force applied to the nut, a number of the junctions will ultimately fail. When the fusible link becomes loosened from the stud mounting the resistance is increased in these areas, which results in increased temperatures. Under certain conditions these temperatures can reach sufficiently high levels to split the insulation on the fusible links, initiating an engine compartment fire that can quickly destroy the automobile and endanger its occupants.

A similar type of failure occurs at the connection or junction between the fusible link and a current-carrying cable. Notwithstanding the best efforts of electrical circuit designers and the highest quality connecting techniques, a highly predictable number of such junctions will ultimately fail. Similar to above, the failure results when the junctions loosen, causing a high resistance between the fusible link and cable. The increased resistance leads to high temperatures in the regions. Under certain conditions, these temperatures can reach sufficiently high levels to burn the insulation covering the cables, initiating a dangerous fire.

U.S. Pat. No. 5,591,366 issued to Schmidt et al. discloses a series of protective coverings over a heating wire connected to a power wire. The heating wire is connected in series to an electrical pin which directly joined to a fuse wire. The fuse wire is then joined to the power wire. Two opposing metal caps are bonded on their inner surfaces to a ceramic tube to form a hermetically sealed shell surrounding the junctions between the fuse wire and pin, and between the fuse wire and power wire. Then, a heat shrinkable tubing is used to grip the caps and ceramic tubing, encasing the fuse area.

Like other prior art devices, the disclosure of U.S. Pat. No. 5,591,366 does not solve the problem of protecting failure at the junctions of the fusible link due to force applied to the cable assembly.

In addition to the excess heat generated due to failures at the junctions of the fusible link and the cable, excess heat is often generated by the fusible link itself causing a failure of the insulative housing as well.

Fusible links are commonly used to interrupt current in electrical circuits. These fusible links may take the form of metal wire that melts upon current overload occurring over pre-designated spans of time. The fusible links may also take the form of thin, fusible pieces of metal that form a bridge between terminals or terminal extensions, such as the thin fusible link that appears in the ATO®, MINI® or MAXI® fuses manufactured and sold by the assignee of the present invention.

Prior art wire link devices are commonly made of copper or tin-plated copper, and are generally insulated with a polymeric or rubber-based insulating cover. Such insulated copper wire links have been generally satisfactory for their intended purposes, but have certain deficiencies that make them less than ideal. For example, copper wire links have very high melting temperatures, i.e., approximately 1083° C. The insulating cover cannot withstand such temperatures and, under certain excessive current conditions, will melt, split, bum or separate from the wire long before the copper wire link melts. Accordingly, there is a perceived need for a fusible link to replace copper wire links in such applications, which would melt at temperatures lower than the deformation or burning temperatures of the insulation, even under conditions which could cause insulation deformation or burning with copper links.

Accordingly, a fusible link and cable assembly in accordance with the present invention eliminates the drawbacks of the prior art devices described above.

SUMMARY OF THE INVENTION

The invention is an improved fusible link, and also an improved fusible link and cable assembly. According to one aspect of the present invention, the invention includes a first cable, a second cable, a fusible link, and a protective housing. The fusible link is comprised of a separate element from the electrical cables. The first and second cables generally have a protective or insulating covering thereon, and an end portion extending past the protective covering. The first and second cables are electrically connected to the fusible link at opposing ends of the fusible link, preferably by compressing the end portions of the cable and welding the compressed end portions to the fusible link.

According to another aspect of the present invention, the fusible link is comprised of a conductive material having a low melting temperature, such as zinc. The fusible link may have at least one aperture from an upper surface thereof, to a lower surface thereof, and/or the fusible link may have notches thereon, the aperture and the notches creating regions of high electrical resistance. Additionally, the fusible link may have a second conductive material distributed thereon, the second conductive material having a lower melting temperature than the material of the fusible link.

According to another aspect of the present invention a protective housing covers the fusible link and portions of the first and second cables. The protective housing comprises interconnecting first and second, or upper and lower housing components. A first channel is located at a first end of the protective housing and houses a portion of the first cable. A second channel is located at a second end of the protective housing and houses a portion of the second cable. An intermediate cavity is located therebetween and houses the fusible link. A portion of the intermediate cavity is spaced away from the fusible link to create a gap between the fusible link and an interior wall of the intermediate cavity.

According to another aspect of the present invention the protective housing further comprises a first rib extending from an interior wall of the first channel and a second rib extending from an interior wall of the second channel. The first rib contacts the protective covering of the first cable to contain the first cable, and the second rib contacts the protective covering of the second cable to contain the second cable.

According to another aspect of the present invention, the first and second housing components have interconnecting members to mate the first and second housing components together.

According to another aspect, and in a second embodiment, the protective housing comprises an inner protective housing, and an outer protective housing. The inner housing encases a portion of the fusible link. An intermediate section of the encased inner housing is spaced away from the fusible link to form a cavity over the fusible link. In a preferred embodiment the inner housing is a two-piece component which interlocks on the fusible link. The inner housing may have protrusions extending from an exterior surface thereof, the protrusions interconnecting with the outer housing.

According to another aspect of the present invention, the outer housing forms a rigid overmolded layer encasing: the inner housing, the fusible link, the electrical connection points between the first and second cables and the fusible link, and a portion of the protective covering on each of the first and second cables. The ends of the outer housing form a rigid mechanical seal with the protective coverings over the cables, thus creating a unitary one-piece housing joining the two cables. Accordingly, the inner and outer housings protectively couple the first and second cables and the fusible link such that the cables will not disassociate from the fusible link when typical forces are applied to the cables and junctions thereof, thus eliminating the hazards of previous cable and fusible link connections.

Other features and advantages of the invention will be apparent from the following specification taken in conjunction with the following drawings.

DETAILED DESCRIPTION OF THE PREFERRED EMBODIMENT

Figure 1:
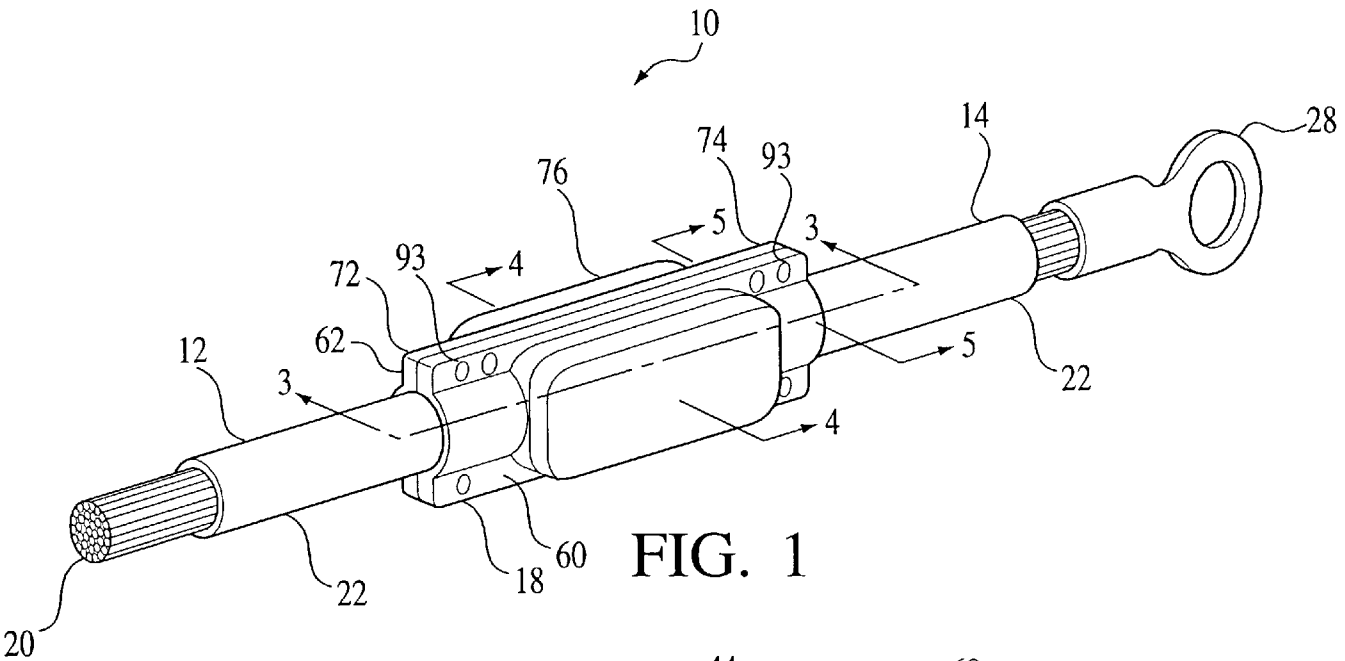
FIG. 1 is a perspective view of a preferred embodiment of one aspect of the cable assembly of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiment illustrated.

Figure 2:
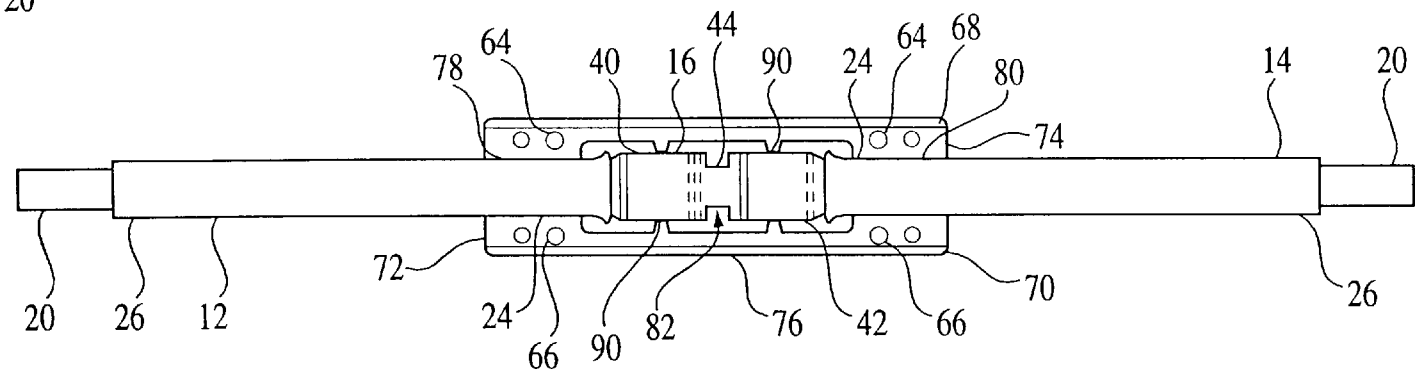
FIG. 2 is a top plan view of one of the components of the protective housing member of the cable assembly of FIG. 1.
Figure 3:
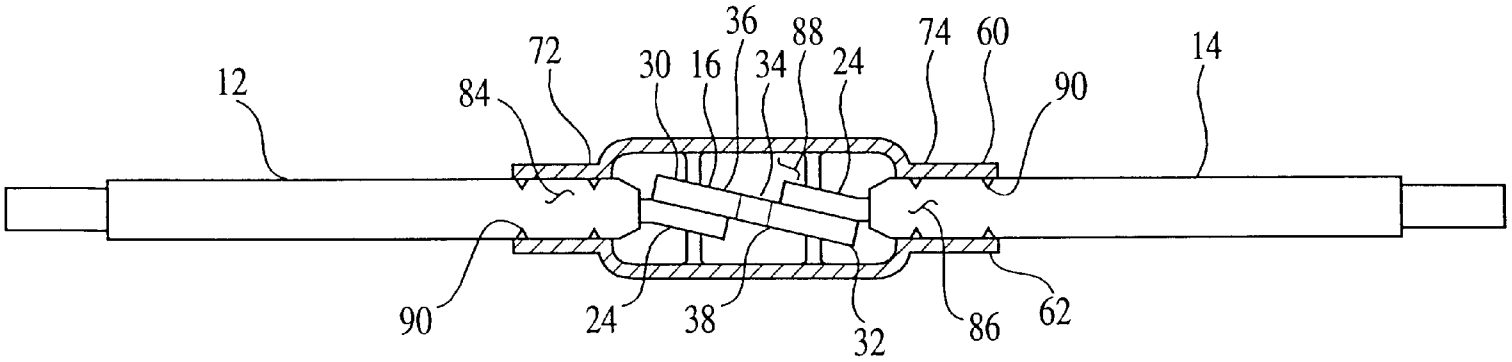
FIG. 3 is a cross-sectional view taken along line 3—3 of FIG. 1.
Figure 10:
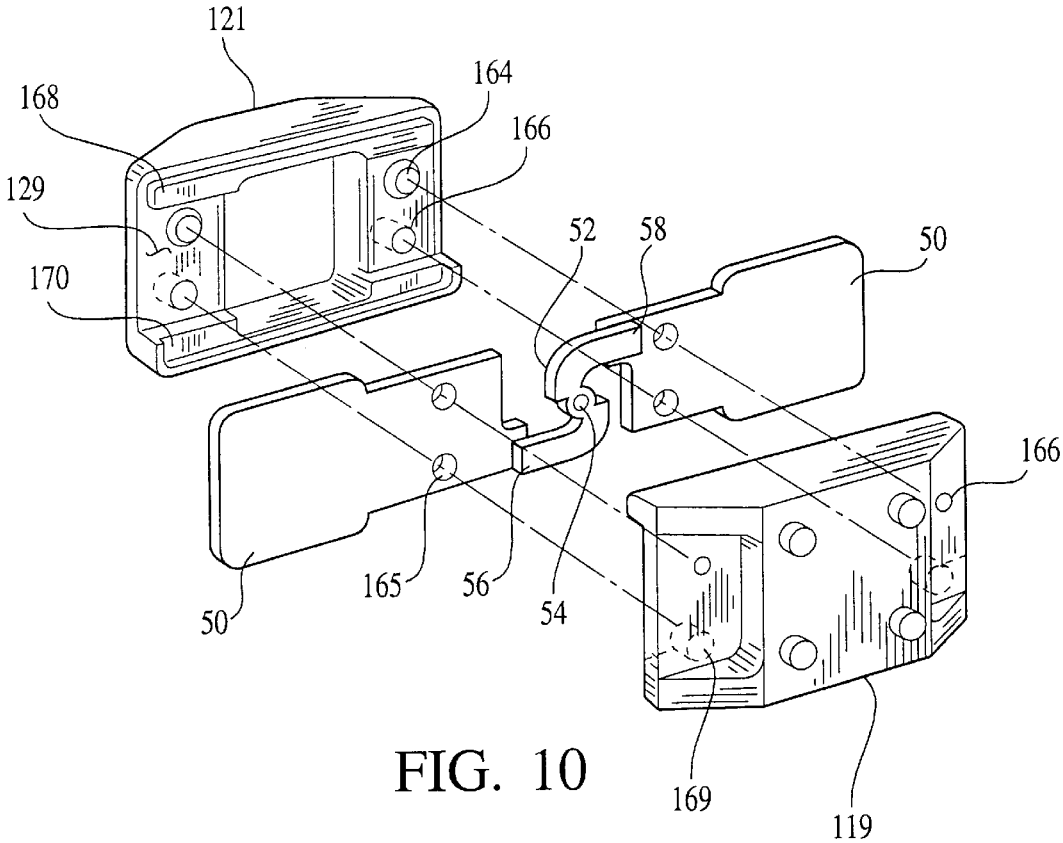

Referring now in detail to the Figures, and initially to FIGS. 1–6, there is shown a preferred embodiment of the present invention. FIG. 1 shows an improved cable assembly 10 including a first cable 12, a second cable 14, a fusible link 16, and a protective housing 18. The present invention is an improvement over the prior art cable and fusible link combination in that the protective housing 18 securably engages the first and second cables 12,14, as shown in FIGS. 1–3, such that the connection between the first and second cables 12,14 or wires and the fusible link 16 will not loosen or break when a force is applied to one or both of the cables. As such, the present embodiment offers stability and safety features previously not available, while additionally offering the ability of having a fusible link 16 made of a different material or configuration as shown in FIG. 10.

Figure 9:
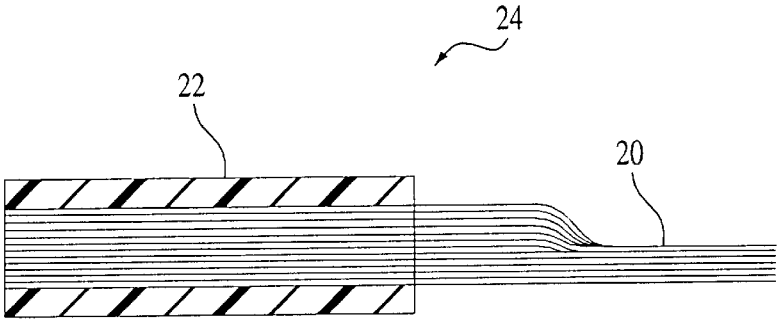
FIG. 9 is a cross-sectional view of one of the cables of the present invention, with a portion of the protective insulation stripped away and the end flattened for attachment to the fusible link; and, FIG. 10 is an exploded perspective view of another embodiment of the fusible link, and another embodiment of the inner insulative housing of the present invention of FIG. 7.

The first and second cables 12,14 are conventional insulated electrical cables and are generally comprised of a core of a plurality of elongated strands or wires 20 surrounded by a protective insulation layer 22, such as polyethylene, as shown in FIG. 9. Nonetheless, a solid wire or cable could be employed as the core for the present invention in lieu of a stranded cable. The cable core 20 is made of a first material, preferably a conductive metal, and more preferably copper. Each of the cables 12,14 generally have a first or proximal end 24, and a second or distal end 26. A portion of the protective covering 22 or insulation adjacent the first or proximal end 24 of each cable is removed or stripped away from the cable. Preferably, a ¾" to 1" portion of insulating covering 22 is removed from the first end 24 of the cable. Thus, the end portion of the cables or wires 20 of the first ends 24 of each of the first or second cables extends past their respective protective coverings 22.

Once the protective covering 22 is removed from the first end 24 of the cable, the exposed end portion 20 of the cable is compressed or flattened. The end portion of the cable is flattened to provide a flat surface for connection with and attachment to the fusible link. The means of compressing the cable wire is wellknown in the art. As such, any conventional means, such as an arbor press, punch press, die, etc., may be used to compress the first end portions 24 of the cables as shown in FIG. 10.

In the preferred embodiment of the present invention the first cable 12 is made of 10 gauge wire. The first cable 12 is approximately 5" long and has a terminal 28 at the second or distal end 26 of the cable for connecting the cable to a power source (not shown). The second cable 14 is generally made of a smaller gauge wire, and in the preferred embodiment is made of an 8 gauge wire. Additionally, the second cable 14 is generally longer, i.e., approximately 18– or longer, and has a terminal 28 at the second or distal end 26 of the cable for connecting to a desired electrical device (not shown) such as the starter of an automobile. The larger gauge cable (i.e., that cable having a smaller diameter wire) increases the flexibility of the overall cable and fuse system. Even though a 10 gauge first cable wire and an 8 gauge second cable wire are utilized in the preferred embodiment, much larger and much smaller gauge wires, for example, from 1 gauge up to at least 20 gauge or larger, may be used as either the first cable, the second cable, or both the first and second cables. Additionally, it is understood that the gauge thickness of the first and second cables could be reversed, as long as one cable is made of a larger gauge wire and one cable is made of a smaller gauge wire.

Further, the first and second cables 12,14 may be made of the same gauge of wire. Generally, however, when the first and second cables are made of the same gauge of wire, a longer third cable (not shown) is spliced to one of the first or second cables. With a multi-cable embodiment, the first and second cables of the cable assembly 10 are made of a smaller gauge wire, and the cable which is spliced to the cable assembly 10 is made of a larger gauge wire. The longer and larger gauge spliced cable, generally the third cable, increases the flexibility of the overall cable and fuse system because of its smaller outside diameter.

Figure 8:
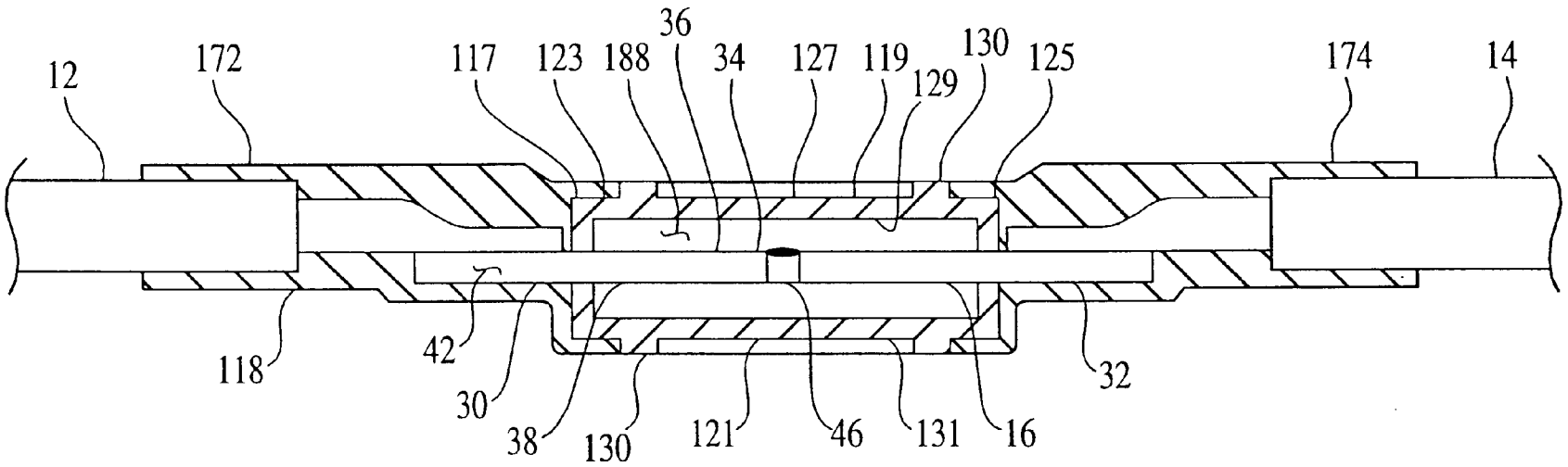
FIG. 8 is a cross-sectional side elevation view along line 8—8 of the cable assembly of FIG. 7.

The fusible link of the preferred embodiment is illustrated in FIGS. 2 and 3. The fusible link 16 is generally an 11 gauge rectangular piece of conductive material, preferably a zinc alloy, with a lower melting temperature and a higher electrical resistance than the wire 20 of the first and second cables 12,14, which is typically copper. The fusible link 16 can be manufactured by conventional stamping techniques. The fusible link 16 comprises opposing first and second ends 30,32 with an intermediate portion 34 therebetween, an upper surface 36, a lower surface 38, and opposing first and second sides 40,42. In the preferred embodiment, the intermediate portion 34 of the fusible link 16 has a notch 44 adjacent each of the opposing sides 40,42 thereof. The notch 44 creates a region of high electrical resistance. In place of a notch, however, an aperture 46 may extend from the upper surface 36 through to the lower surface 38 of the intermediate portion 34 of the fusible link (See FIG. 8). The aperture 46, like the notch 44, provides an area of high electrical resistance for more rapid heating in this area. Additionally, a second conductive material 48 may be distributed on the fusible link 16 to lower the melting temperature of the fusible link. Preferably a tin or tin/lead spot 48, as shown in FIG. 8, is distributed on the fusible link 16.

In the preferred embodiment the fusible link 16 is made of a metal or metal alloy with a melting point of 450° C. or less, most preferably a zinc alloy. The zinc alloy used in the preferred embodiment of the present invention has a composition of 99.9% zinc, with the remainder being impurities. The zinc alloy has the advantage of melting at a much lower temperature, approximately 400° C., than the copper wires 20 of the cable which have a melting temperature of approximately 1080° C., or even tin-coated copper which has an effective melting point of about 550° C.

Notwithstanding the above, the fusible link 16 can be made of any suitable conductive metal which can form a fuse element that, when properly configured, melts to open the circuit under both short circuit conditions and under prolonged modest overload conditions. The central portion or intermediate portion 34 may be thinner than the ends 30,32. Additionally, the intermediate portion 34 may be configured of a S-shaped or serpentine shaped fuse link as shown in FIG. 10.

The fusible link 16 may also be made of a plurality of conductive materials. As shown in FIG. 10 the fusible link comprises a first copper member 50, a second copper member 50, and an intermediate zinc member 52. The intermediate zinc member 52 is a serpentine shape and has an aperture 54 at a midpoint thereof. Opposing ends 56,58 of the intermediate member 52 are welded by sonic means to the appropriate connection points on the first and second members 50,52, respectively. The first cable 12 is then connected to the first member 50 and the second cable 14 is connected to the second member 52.

Figure 7:
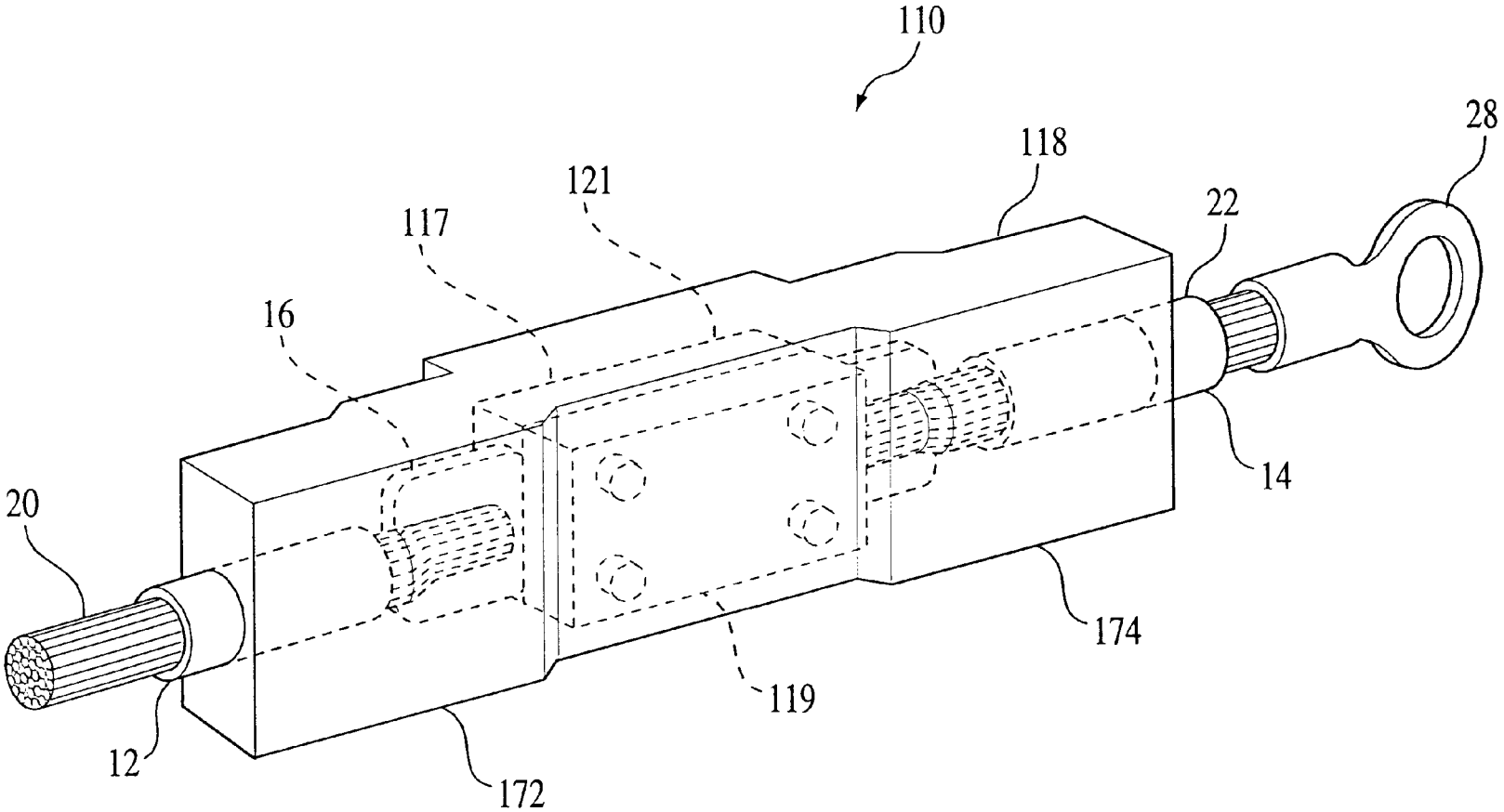
FIG. 7 is a cross-sectional perspective view of another embodiment of the cable assembly of the present invention.

The flattened first end portion 24 of each of the first and second cables 12,14 is electrically connected to the fusible link 16 adjacent the opposing first and second ends 30,32 of the fusible link, respectively. The first end portion 24 of the first cable 12 is electrically connected to the fusible link 16 adjacent the first end 30 of the fusible link, thereby creating a first connection point. Similarly, the first end portion 24 of the second cable 14 is electrically connected to the fusible link 16 adjacent the second end 32 of the fusible link, thereby creating a second connection point. As such, the fusible link 16 is located between and electrically connects the first and second cables 12,14. The means for electrically connecting the cables 12,14 to the fuisible link 16 is accomplished by compressing and/or welding the cable to the fusible link. Other means, including soldering and sonic welding, can be employed as well. As shown in FIGS. 2 and 3, the first cable 12 and the second cable 14 may be connected to opposing surfaces 36,38 of the fusible link 16. However, as shown in FIGS. 7 and 8, the first cable 12 and the second cable 14 may be connected to the same surface of the fusible link 16, which is preferred.

Once the fusible link 16 is electrically connected to the first and second cables 12,14, the protective housing 18, as shown in FIGS. 1–6, is affixed thereto. In this embodiment the protective housing 18 comprises an upper or first component or housing member 60 and a lower or second component or housing member 62. The first and second components 60,62 have interconnecting members which mate to fixedly connect the first and second components 60,62 together. When interconnected, the protective housing 18 covers the fusible link 16 and portions of the first and second cables 12,14. The protective housing 18 and the members 60,62 thereof are generally made of a heat resistant plastic material.

Figure 4:
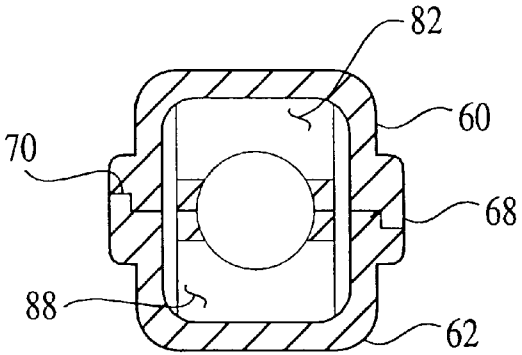
FIG. 4 is a cross-sectional view taken along line 4—4 of FIG. 1.
Figure 5:
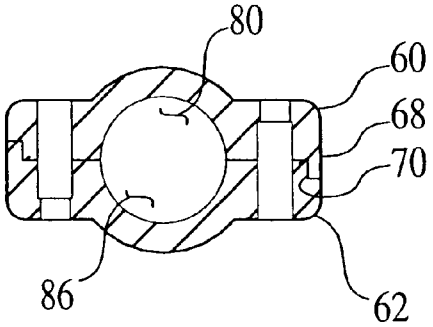
FIG. 5 is a cross-sectional view taken along line 5—5 of FIG. 1.
Figure 6:
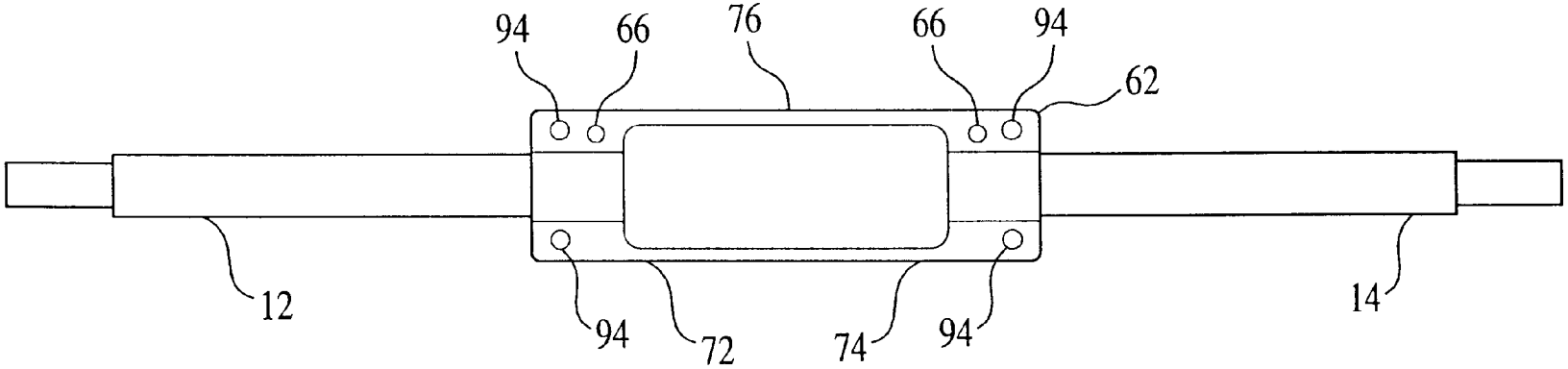
FIG. 6 is a bottom plan view of one of the components of the protective housing member of the cable assembly of FIG. 1.

The first and second components 60,62 each have mating interconnecting members to aid in connecting the two components. As best shown in FIG. 2, the first and second components 60,62 have posts 64 and apertures 66 which mate to locate the first and second components 60,62 with respect to one another for connecting the components to form the overall protective housing. Additionally, the first and second components 60,62 each have a shoulder 68 and groove 70 as shown in FIGS. 2 and 4. The shoulder 68 extends adjacent a side of each of the first and second components 60,62. Similarly, the groove 70 extends adjacent the opposing side of each of the first and second components 60,62. The shoulder 68 of the first component 60 mates with the groove 70 the second component 62 and the shoulder 68 the second component 62 mates with the groove 70 of the first component 60. In addition to operating as another locating means for the first and second components, the mating shoulders 68 and grooves 70 provide a seal area about the sides of the protective housing 18.

As shown in FIGS. 1–6, the protective housing 18 itself, as well as the first and second components 60,62 of the protective housing, has a first end portion 72, a second end portion 74, and an intermediate section 76 therebetween. With regard to both the first and second components 60,62, the first end portion 72 of each component has a first cavity 78, the second end portion 74 of each component has a second cavity 80, and the intermediate section 76 of each component has an intermediate cavity 82. The intermediate cavity 82 of the first and second components has a greater volume than that of the first and second cavities 78,80 of both the first and second components.

After the first and second components are connected together to form the overall protective housing, the protective housing 18 can be said to have a first channel 84 at a first end 72 thereof which houses a portion of the first cable 12; a second channel 86 at the second end 74 thereof which houses a portion of the second cable 14; and, an intermediate cavity 88 between and connecting the first channel 84 and the second channel 86 (See FIG. 3). The first channel 84 is comprised of the first cavity 78 of the first and second components 60,62, the second channel 86 is comprised of the second cavity 80 of the first and second components 60,62, and the intermediate cavity 88 of the protective housing 18 is comprised of the intermediate cavities 82 of the first and second components 60,62. The intermediate cavity 88 houses the fusible link 16. A portion of the intermediate cavity 88 is spaced a distance away from the fusible link 16 to create a gap between the fusible link 16 and an interior wall of the intermediate cavity 88, thereby encasing the fusible link 16.

As best shown in FIG. 3, the protective housing 18 further has protrusions or engaging means 90 extending into the first, second, and intermediate cavities 78,80,82. In the first 78 and second 80 cavities the engaging means 90 protrude from the first and second components 60,62 for gripping and containing the cables 12,14. A first engaging means 90 is adjacent the first end 72 thereof and extends into the first cavity 78, and a second engaging means 90 is adjacent a second end 74 thereof and extends into the second cavity 80. Further, engaging means 90 also extend from the interior wall of the intermediate cavity 82 to locate the fusible link 16. In the preferred embodiment, the protective housing 18 has engaging means 90 adjacent the first and second ends 72,74 of both the first and second components 60,62. The first engaging means 90 of the first and second components 60,62 contacts the protective covering 72 of the first cable 12 to grip and contain the first cable, and the second engaging means 90 of the first and second components 60,62 contacts the protective covering 22 of the second cable 14 to grip and contain the second cable. Generally, the engaging means 90 is an internal protrusion or rib extending from the protective housing 18. In a preferred embodiment a first rib extends from an interior wall of the first channel and a second rib extends from an interior wall of the second channel. In the first and second cavities 78,80 and channels 84,86 the ribs 90 contact the protective covering 22 of the respective cables 12,14. When the two components 60,62 of the protective housing are mated and firmly connected together, portions of the ribs 90 are indented into the insulative layer 22 of the cable. This allows the engaging means 90 to securely grip and contain the cable 12,14 such that the cable is not capable of movement with respect to the protective housing 18. In the preferred embodiment, the ribs 90 in the first and second cavities have an apex for securely engaging the cable. As such, the first cable 12, the protective housing 18, the fusible link 16, and the second cable 14 form a unitary element.

The inside diameter of the first and second cavities 78,80, and thus of the formed channels 84,86 can be varied to accommodate different size cables. Additionally, the height of the engaging means 90 varies accordingly with the variation in the cavity diameter. For a 6 gauge cable the cavity diameter is approximately 0.308" and the height of the engaging means is 0.98". For an 8 gauge cable the cavity diameter is approximately 0.270" and the height of the engaging means is 0.88". For a 10 gauge cable the cavity diameter is approximately 0.244" and the height of the engaging means is 0.73". Even though the cavity diameter and engaging means height can be varied, a small change in the size of the cable does not necessarily require a change in the cavity diameter of the housing. The parameters of the cavity 84,86 and engaging means 90 are such that a certain size cavity can accommodate small increases and decreases in the diameter of the cable 12,14.

Once the first and second housing components 60,62 are mated around and over the fusible link 16 and portions of the first and second cables 12,14, the first and second housing components 60,62 are fixedly connected with rivets 93 which extend through apertures 94 in the housing members 60,62. In the preferred embodiment an aperture 94 and corresponding rivet 93 are located adjacent each of the four comers of the protective housing 18. It should be known however, that the first and second housing components 60,62 could be fixedly connected by any other means, including adhesives, welding, or any other connecting means. By fixedly connecting the first and second housing components 60,62 together, the engaging means 90 are maintained securely in the protective covering 22 of the cables 12,14 to maintain the cables in place. As such, the cable 12,14 and fusible link 16 are securely connected to the housing 18.

Another preferred embodiment of the present invention is illustrated in FIGS. 7 and 8. The illustrations of this embodiment incorporate the reference numerals of the previously identified embodiment for identical parts thereof. FIGS. 7 and 8 show a cable 110 assembly including a first cable 12, a second cable 14, a fusible link 16, an inner protective housing 117 and an outer protective housing 118. Like the first embodiment, the present invention is an improvement over the prior art cable and fusible link assemblies in that the outer protective housing 118 securably engages the first and second cables 12,14, such that the connection between the first and second cables 12,14, or wires thereof, and the fusible link 16 will not loosen or break.

In this embodiment, the fusible link 16 and cables 12,14 are similar to those described above, however the protective housing differs. The protective housing of this embodiment includes an inner housing 117 and an outer protective housing 118. The inner protective housing 117 is placed over a portion of the fusible link 16, encasing and partially surrounding at least the intermediate portion 34 of the fusible link 16. The inner housing 117 is between the outer protective housing 118 and the fusible link 16. The outer protective housing 118 is placed over the inner protective housing 117 and is secured to the first and second cables 12,14.

As illustrated in FIGS. 7 and 8, the inner insulating housing 117 comprises two pieces or parts, an upper or first housing member 119 and a lower or second housing member 121. Whether in one or two pieces, each element of the inner housing 117 has a first end 123, a second end 125 and an intermediate section 127. The inner housing 117 also has an interior wall or surface 129 and an exterior wall or surface 131 as well. The inner housing 117 is utilized so as to provide an encasing and protecting shell around at least the intermediate portion 34 of the fusible link, such that a cavity 188 is formed around the intermediate portion 34 of the fusible link. The cavity 188 is formed by having a portion of the interior wall 129 of the upper and lower parts 119,121 of the inner housing spaced away from the upper and lower surfaces 36,38, and the opposed side surfaces 40,42 of the fusible link, respectively. The cavity 188 may be over the upper surface 36 and/or lower surface 38, but preferably the cavity 188 surrounds a portion of the entire periphery of the fusible link 16. When in place, the first part 119 of the inner housing is adjacent the upper surface 36 of the fusible link, with the first end 123 being proximal the first end 30 of the fusible link and the second end 125 being proximal the second end 32 of the fusible link, and the second part 121 of the inner housing is adjacent the lower surface 38 of the fusible link, with the first end 123 being proximal the first end 30 of the fusible link and the second end 125 being proximal the second end 32 of the fusible link. As such, the opposing ends 123,125 of the inner insulating housing are adjacent and between the electrical connections of the fusible link 16 to the first and second cables 12,14, respectively, and the intermediate section 127 of the inner housing is spaced away from a portion of the entire periphery (i.e., the upper and lower surfaces 36,38, and the opposing sides 40,42) of the fusible link 16 to define a central space or cavity 188 thereover, between the fusible link 16 and the inner housing 117.

Both parts 119,121 of the inner housing 117 are made of molded plastic. Additionally, both housing halves are identical, but one half housing is rotated 180° with respect to the other for interlocking of the mating elements. The housing halves are preferably made in accordance with the teachings of commonly assigned U.S. Pat. No. 5,293,147. As such, the disclosure of U.S. Pat. No. 5,293,147 is incorporated herein by reference, and made a part hereof. The first and second parts 119,121 of the inner housing have mating male shoulders 168 and female slots 170 adjacent their opposing sides. The mating shoulders 168 and slots 170 allow the inner housing members to interconnect around the fusible link. The shoulders 168 extend outwardly from the inner faces 129 adjacent side walls of each housing half and extend into the slot 170 in the opposite housing half. As shown in FIG. 7 and 10, the shoulders 168 of each housing half fit into the slots 170 of the other housing half and the confronting surfaces of the interior walls 129 form a cavity 188 around a portion of the fusible link 16. The housing halves are preferably made of a thermoplastic material and may be ultrasonically welded together.

The first and second parts 119,121 of the inner housing 117 may also have mating positioning pins 164 and pin receiving holes 166 as shown in FIG. 10. With this embodiment, the fusible link 16 has corresponding apertures 165 therethrough such that the positioning pins 164 are placed through the apertures 165 in the fusible link 16 and mate with the pin receiving holes 166 in the opposing housing half. Positioning pins 164 are not necessarily required, however, because the interconnected inner housing fits horizontally between the ends of the first and second cables 12,14 on the fusible link 16.

As shown in FIG. 7, the inner housing 117 has protuberances 130 extending from its exterior surface 131. The protuberances 130 allow the inner housing 117 to mate with the outer overmolded housing 118. During manufacture of the outer housing 118, the outer housing 118 mates or connects with the inner housing 117 to form a rigid interlocking component. Thus, the outer and inner housings 117,118, along with the fusible link 16 have a rigid interlocking relationship. Similarly, the ends 172,174 of the outer housing and the protective coverings 22 of the cables have a rigid interlocking relationship such that no outside force is applied to the connection points between the cables 12,14 and the fusible link 16. All outside twisting or bending forces are applied to the connection between the outer housing 118 and the protective covering 22 of the cables 12,14. As such, the problems found in the prior art are eliminated.

Exterior of the inner housing 117 is the outer, second or overmolded protective housing 118 which is preferably made of a plastic, and more preferable made of a thermoplastic. The outer housing 118 covers and encases the fusible link 16, the insulating or inner housing 117, the electrical connections and connection points between the fusible link 16, and portions of the protective covering 22 of the first and second cables 12,14, respectively. The protective housing 118 has a first end 172 and a second end 174 which cover a portion of the protective covering 22 of each of the first and second cables 12,14. The first and second ends 172,174 of the outer protective housing 118 also form a rigid connection with the protective coverings 22 of the first and second cables due to the overmolding process.

One type of overmolding process used to create the outer housing 118 is injection molding. Injection molding is preferred because polymerization and cross-linking of the plastics takes place between the outer protective coverings 22 of the cables and the outer housing 118.

The heat generated during the molding process of the molten plastic partially melts a portion of the insulative covering 22 of the cables. This allows a deep fusion to take place at the interface between the first and second cable 12,14 and the outer housing 118. At these points a cross-linked bond is formed between portions of the first and second cables 12,14, and the outer housing 118. In a preferred embodiment, the protective coverings 22 of the first and second cables and the outer housing 118 form an integrated bond at the molecular level. Typical materials used for the outer protective housing 118 include acrylics, nylon, polyethylene, polyester, polypropylene, polycarbonate, and polyvinyl chloride.

The first end 172 of the outer protective housing 118 sealably engages the protective covering 22 of the first cable 12, and the second end 174 of the outer protective housing 118 sealably engages the protective covering 22 of the second cable 14. The sealable engagements between the ends of the outer protective housing is much more rigid and forms a mechanical connection which is able to withstand much higher bending and twisting forces than previous attachments via shrink formed tubing. As such, the outer protective housing 118 forms a rigid element with the first and second cables 12,14 such that the first and second cables cannot be separated from the outer protective housing, and thus also the fusible link, without using excessive force.

The outer housing 118 is a unitary element which is thermoformed or molded, preferably by injection molding techniques, directly over the fusible link 16, inner housing 117, the ends 24 of the first and second cables 12,14, and their respective insulation layer 22.

While the specific embodiments have been illustrated and described, numerous modifications come to mind without significantly departing from the spirit of the invention, and the scope of protection is only limited by the scope of the accompanying Claims.

We claim:

1. An improved cable assembly for electrical overload protection, the cable assembly comprising:

a first cable having a protective covering and an end portion extending past the protective covering;

a second cable having a protective covering and an end portion extending past the protective covering;

a fusible link having opposing first and second ends, wherein the end portion of the first cable is electrically connected to the fusible link adjacent the first end of the fusible link, and wherein the end portion of the second cable is electrically connected to the fusible link adjacent the second end of the fusible link; and, a protective housing covering the fusible link and portions of the first and second cables, the protective housing comprising a first component and a second component, the first and second components each having a first end portion contacting the first cable, a second end portion contacting the second cable, and an intermediate section therebetween, the first and second components each having a means for engaging the first cable adjacent the first end thereof and a means for engaging the second cable adjacent the second end thereof, wherein a portion of the intermediate section is spaced a distance from the fusible link to form a cavity which encases the fusible link, wherein the means for engaging the first cable contacts the protective covering of the first cable to contain the first cable, and wherein the means for engaging the second cable contacts the protective covering of the second cable to contain the second cable.

2. The cable assembly of claim 1, wherein the first and second components are fixedly connected together and around the fusible link and portions of the first and second cables.

3. The cable assembly of claim 1, wherein the first and second components having interconnecting members, the first and second components mating about the interconnecting members to form a rigid housing around the fusible link and portions of the first and second cables.

4. The cable assembly of claim 3, wherein the first component further comprises a shoulder extending adjacent a side of the first component, and the second component further comprises a groove extending adjacent a side of the second component, the shoulder of the first component being capable of mating with the groove of the second component.

5. The cable assembly of claim 1, wherein the fusible link comprises a conductive material that is the same as the conductive material comprising the first and second cables.

6. The cable assembly of claim 1, wherein the means for engaging the cable comprises a rib protruding from the protective housing.

7. The cable assembly of claim 1, wherein the fusible link comprises a first conductive material having a lower melting temperature than a conductive material comprising the first and second cables.

8. The cable assembly of claim 7, wherein the fusible link comprises a zinc alloy.

9. The cable assembly of claim 1, wherein the fusible link further comprises at least one notch, thereby creating regions of high electrical resistance.

10. The cable assembly of claim 1, wherein a second conductive material is distributed on the fusible link.

11. The cable assembly of claim 1, wherein the first cable and the second cable are made of the same gauge of cable.

12. The cable assembly of claim 1, wherein the first cable and the second cable are made of different gauge cables.

13. An improved cable assembly for electrical overload protection, the cable assembly comprising:

a first cable having a protective covering and an end portion extending past the protective covering;

a second cable having a protective covering and an end portion extending past the protective covering;

a fusible link having opposing first and second ends, wherein the end portion of the first cable is electrically connected to the fusible link adjacent the first end of the fusible link, and wherein the end portion of the second cable is electrically connected to the fusible link adjacent the second end of the fusible link; and, a protective housing covering the fusible link and portions of the first and second cables, the protective housing comprising interconnecting first and second housing components, the protective housing having a first channel at a first end thereof housing a portion of the first cable, a second channel at a second end thereof housing a portion of the second cable, and an intermediate cavity therebetween housing the fusible link, wherein a portion of the intermediate cavity is spaced away from the fusible link to create a gap between the fusible link and an interior wall of the intermediate cavity, and wherein the protective housing further comprises a first rib extending from an interior wall of the first channel and a second rib extending from an interior wall of the second channel, the first rib contacting the protective covering of the first cable to contain the first cable, and the second rib contacting the protective covering of the second cable to contain the second cable.

14. The cable assembly of claim 13, wherein the first and second housing components have interconnecting members to mate the first and second housing components together.

15. The cable assembly of claim 13, wherein the first housing component has a shoulder extending adjacent a side of the first housing component, wherein the second housing component has a groove extending adjacent a side of the second housing component, and wherein the shoulder of the first housing component is capable of mating with the groove of the second housing component.

16. The cable assembly of claim 13, wherein the first and second housing members are fixedly connected to each other and around the fusible link and portions of the first and second cables.

17. The cable assembly of claim 13, wherein the fusible link comprises a first conductive material having a lower melting temperature than a conductive material comprising the first and second cables.

18. The cable assembly of claim 17, wherein the fusible link comprises a zinc alloy.

19. The cable assembly of claim 13, wherein the fusible link further comprises notches, thereby creating regions of high electrical resistance.

20. The cable assembly of claim 13, wherein the first cable and the second cable are made of the same gauge of cable.

21. The cable assembly of claim 13, wherein the first cable and the second cable are made of different gauge cables.

22. An improved cable assembly for electrical overload protection, the cable assembly comprising:

a first cable having a first end and a second end;

a second cable having a first end and a second end;

a fusible link comprised of a low melting temperature conductive material having opposed first and second ends, an intermediate portion, an upper surface, a lower surface, and opposing side surfaces, wherein the upper, lower, and opposing side surfaces define a periphery of the fusible link, wherein the first end of the first cable is electrically connected adjacent the first end of the fusible link, and wherein the first end of the second cable is electrically connected adjacent the second end of the fusible link; and, an integral overmolded protective housing encasing the fusible link, the first end of the first cable and the first end of the second cable to form a permanent unitary element with the cables, wherein an interior wall of the protective housing is spaced away from a portion of the fusible link, and wherein a first end of the overmolded protective housing forms a mechanical connection with the first cable distal the fusible link and a second end of the integral overmolded protective housing forms a mechanical connection with the second cable distal the fusible link.

23. The cable assembly of claim 22, further comprising an inner insulating housing between the overmolded protective housing and the fusible link, a first part of the inner insulating housing adjacent the upper surface of the fusible link and a second part of the inner insulating housing adjacent the lower surface of the fusible link, wherein opposing ends of the inner insulating housing are adjacent and between the electrical connections of the fusible link to the first ends of the first and second cables, respectively, and wherein an intermediate section of the inner insulating housing is spaced away from a portion of the upper and lower surfaces and sides of the fusible link to define a cavity therebetween the fusible link and the inner insulating housing.

24. The cable assembly of claim 23, wherein the inner insulating housing mates with the overmolded protective housing.

25. The cable assembly of claim 22, further comprising a terminal at the second end of the first cable for connecting the first cable to an electrical device or power source.

26. The cable assembly of claim 22, wherein the first end of the first cable is compressed and welded to the fusible link adjacent the first end thereof, and wherein the first end of the second cable is compressed and welded to the fusible link adjacent the second end thereof.

27. The cable assembly of claim 23, wherein the inner insulating housing has protuberances which mate with the overmolded protective housing.

28. The cable assembly of claim 23, wherein the overmolded protective housing is made of a unitary overmolded plastic element which is molded over the fusible link, the end portions of the first and second cables electrically connected to the fusible link, and portions of the protective covering of the first and second cables, respectively, to form a rigid element connecting the first and second cables such that the first and second cables cannot be separated with using excessive force.

* * * * *